US005281460A

United States Patent [19]

Cox

[11] Patent Number: 5,281,460

[45] Date of Patent: Jan. 25, 1994

[54] INFRARED CAMOUFLAGE COVERING

[75] Inventor: Phillip R. Cox, Madison, Ala.

[73] Assignee: Teledyne Industries, Inc., Los Angeles, Calif.

[21] Appl. No.: 900,428

[22] Filed: Jun. 18, 1992

Related U.S. Application Data

[62] Division of Ser. No. 621,463, Dec. 4, 1990, abandoned.

[51] Int. Cl.[5] ..... B32B 5/12; A01N 3/00

[52] U.S. Cl. ..... 428/112; 428/17; 428/114; 428/132; 428/136; 428/263; 428/265; 428/267; 428/332; 428/333; 428/461; 428/919; 2/69

[58] Field of Search ..... 428/17, 132, 136, 332, 428/919, 461, 333, 236, 263, 265, 267, 112, 114; 2/69

[56] References Cited

U.S. PATENT DOCUMENTS

| | | | |
|---|---|---|---|
| 1,139,642 | 5/1915 | Cox | 2/69 |
| 1,144,150 | 6/1915 | Marcovsky | 2/69 |
| 2,351,142 | 6/1944 | Mitchell | 428/919 |
| 2,911,652 | 11/1959 | Ekman | 2/69 |
| 3,069,796 | 12/1962 | Ruter | 428/919 |
| 4,308,882 | 1/1982 | Pusch et al. | 428/919 |
| 4,375,488 | 3/1983 | Hogan | 428/17 |
| 4,495,239 | 1/1985 | Pusch et al. | 428/919 |
| 4,517,230 | 5/1985 | Crawford | 428/919 |
| 4,529,633 | 7/1985 | Karlsson | 428/17 |
| 4,560,595 | 12/1985 | Johansson | 428/17 |
| 4,621,012 | 11/1986 | Pusch | 428/919 |
| 4,656,065 | 4/1987 | Yacovella | 428/17 |
| 4,743,478 | 5/1988 | Pusch | 428/17 |
| 4,868,019 | 9/1989 | Knickerbocker | 428/17 |
| 5,013,375 | 5/1991 | Lenard | 428/17 |
| 5,079,048 | 1/1992 | Anitole | 428/17 |

FOREIGN PATENT DOCUMENTS

| | | |
|---|---|---|
| 2252431 | 5/1974 | Fed. Rep. of Germany . |
| 1605131 | 12/1981 | United Kingdom . |

OTHER PUBLICATIONS

*Combat Mission* magazine, Sep. 1988 issue, pp. 9–19 and two-page insert.

*Primary Examiner*—George F. Lesmes
*Assistant Examiner*—Terrel Morris
*Attorney, Agent, or Firm*—Beveridge, DeGrandi, Weilacher & Young

[57] ABSTRACT

A camouflage covering is provided which includes an underlying layer of lightweight porous material such as a nylon mesh. Elongated strips are attached at one of their ends to the underlying layer of material. The strips have various emissivity values which are arranged in patterns which avoid having strips of the same emissivity value adjacent one another. The strips tend to disrupt both the shape and the brightness of an underlying object's infrared emission. Also, the strips tend to absorb the radiation being emitted from the underlying object. In one embodiment, the loosely hanging strips attached to the underlying layer form a personal infrared camouflage garment which protects a user from detection by infrared detection devices. To prevent prolonged contact between the person wearing the garment and the underlying layer, a plurality of insulating devices can be used such as an insulated helmet or shoulder pad. Securement devices are also provided to secure the underlying layer to the person. In another embodiment, the camouflage covering is used to prevent detection of underlying structures. Preferably, the different emissivity value strips are formed of the same base material (silver coated nylon) and varying sized paint blotches are added to the base material to achieve different emissivity values as well as visible camouflaging.

29 Claims, 6 Drawing Sheets

INFRARED CAMOUFLAGE COVERING

This is a continuation of copending application Ser. No. 07/621,463 filed on Dec. 4, 1990, now abandoned.

FIELD OF THE INVENTION

The present invention relates to a camouflage covering which avoids the detection of an underlying object by infrared detection devices. More particularly, the present invention relates to a personal infrared camouflage garment which protects individuals from being detected with infrared detection devices or a camouflage covering which makes infrared detection of structures such as tanks, buildings, etc. difficult.

TECHNICAL BACKGROUND

Heat transfer occurs in three different modes; conduction, convection and radiation. Conduction arises from temperature gradients within a material wherein, in general terms, energy is transferred during collisions of adjacent molecules and the migration of free electrons from the warmer gradient areas to the cooler gradient areas.

Convection is heat transferred between a solid surface and an adjacent moving fluid. In accordance with Newton's law of cooling, $q=hA\Delta T$ where "q" represents the heat transfer rate (BTU/hr). A the area of interface between solid and liquid and "h" the surface coefficient of heat transfer.

When two objects at different temperatures are placed a finite distance apart in a perfect vacuum, a net energy transfer occurs from the higher temperature object to the lower temperature object even though there is no medium between them to support heat transfer by either conduction or convection. This net energy transfer results from the third mode of heat transfer called thermal radiation, or simply, radiation. Any surface at an absolute temperature above zero degrees Rankine is found to continually emit energy carrying electromagnetic waves. The rate at which any given surface emits radiant energy per unit area of surface is a complex function of the surface temperature, type of material, and surface condition. However, for the class of surfaces defined as black bodies, which absorb all incident radiant energy, the emission rate is given by a simple expression called the Stefan-Boltzmann law which states that $$W_b=\delta T^4, \quad (1)$$

where $W_b$ is the emission rate of a black surface per unit area of surface with units of BTU/hr ft$^2$, T is the absolute temperature in degrees Rankine, and $\delta$ is a universal constant which is given by $$\delta=0.1714\times10^{-8}\ \text{BTU/hr ft}^2\cdot\text{R}^4 \quad (ii)$$

in a system of units consistent with the ones chosen for $W_b$ and T. Real surfaces emit at a rate lower than a black surface at the same temperature, although some, such as graphite and soot, come fairly close to the black surface emission rate given by (i) above. For an actual surface at temperature T with an emissive power W which is less than $W_b$ at temperature T, the expression for the emission rate is $$W=\epsilon\delta T^4, \quad (iii)$$

where $\epsilon$ is the total hemispheric emissivity and depends upon the type of material, surface temperature, and surface condition; $\epsilon$ is a number between zero and unity. Some values of $\epsilon$ for different materials subject to relatively low temperatures are provided below.

| | |
|---|---|
| Silver, highly polished | 0.02 |
| Gold, polished | 0.02 |
| Platinum highly polished | 0.05 |
| Zinc, highly polished | 0.05 |
| Aluminum, highly polished | 0.08 |
| Monel metal, polished | 0.09 |
| Nickel, polished | 0.12 |
| Copper, polished | 0.15 |
| Stellite, polished | 0.18 |
| Cast iron, polished | 0.25 |
| Monel metal, oxidized | 0.43 |
| Aluminum paint | 0.55 |
| Brass, polished | 0.60 |
| Oxidized copper | 0.60 |
| Oxidized steel | 0.70 |
| Bronze paint | 0.80 |
| Black gloss paint | 0.90 |
| Concrete, rough | 0.94 |
| White lacquer | 0.95 |
| White vitreous enamel | 0.95 |
| Asbestos paper | 0.95 |
| Green paint | 0.95 |
| Gray paint | 0.95 |
| Lamp black | 0.95 |
| Paints, oil, all colors | 0.89 to 0.97 |

The distribution of thermal radiation in wavelengths is primarily between 0.1 and 100 microns which includes the visible radiation between about 0.3 and 0.7 microns. Infrared radiation is generally held to cover the range of wavelengths extending from 0.8 microns to 1000 microns.

The human body, due to its maintenance of a constant internal temperature emits copious amounts of infrared radiation primarily in the thermal wavelength bands of 3–5 microns and 8–14 microns. Various structures such as buildings, ships, tanks, etc. also give off copious amounts of radiation. The radiation emitted by persons and various structures is easily detectable by current infrared sensors used by military services for surveillance and gunnery.

Those objects emitting the higher amounts of radiation appear as the brightest objects to the infrared detection devices while the objects giving off only a small amount of radiation appear essentially as a black body. The objects which will emit the highest amounts of radiation are those having the highest emissivity values, highest temperature or both as made evident by equation (ii) above. Those objects giving off the least amount of radiation are those objects having low emissivity values and/or low temperatures. The objects emitting radiation in amounts between these extremes appear as various shades of gray to the detection device.

In many instances, it is desirable that personnel or equipment be able to remain undetected when facing these sensors.

SUMMARY OF THE INVENTION

The present invention features a camouflage covering having an underlying layer of material large enough to drape over an object being protected (e.g., a human body) from infrared detection. The underlying layer serves as the basis for the attachment of a multiplicity of special fabric strips serving as infrared signature and shape disrupters.

The strips are preferably arranged so as to overlap both with respect to strips positioned on each side as well as strips above and below. The emissivity values of the strips varies from strip to strip and it is preferable to have both a great deal of diversity in the emissivity values and a great deal of diversity in the positioning of the various emissivity valued strips on the underlying layer.

The underlying layer is formed of a lightweight but sturdy material such as nylon arranged in a mesh pattern. The mesh has relatively wide openings (e.g., ⅛ to ¾ inch wide) to allow for a large degree of air circulation.

In a preferred embodiment, the camouflage covering is in the form of a personal infrared camouflage garment. The underlying layer includes snaps or the like for attaching the underlying layer to a shoulder harness, belt, etc.

A high foliage environment shows up on an infrared camera as being essentially a plurality of different shades of gray (mostly dark gray) and black. Thus a person placed in a foliage environment would show up on an infrared camera as a beacon of bright light against a dark gray background.

An object of the present invention is to provide a personal infrared camouflage garment which is able to prevent detection of the person by a combination of masking and blocking of the radiation being emitted by the body. In so doing, the reflective strips of the suit reflect a portion of the infrared radiation emitted by the wearer back towards the wearer, where it is absorbed, reradiated, or converted to convective heat by heating the surrounding circulating air. The remaining amount of the radiation emitted by the wearer is absorbed by the surrounding strips, thereby heating them. As the strips warm, they radiate their own heat at a rate proportional to their emissivity in the infrared. The strips differ in their emissivities; therefore, they radiate their heat at differing rates. No adjacent strips have the same emissivity, and in this way the suit duplicates the chaotically-varying pattern of heat emission inherent in normal outdoor foliated scenes.

Further, the chaotic nature of the thermal radiation emission of the suit is enhanced by attaching only one point of each strip to the fabric sheet—allowing the strips to drape and move with the movement of the wearer. As the wearer crouches or lies, the strips bunch, intertwine, and fold about themselves—further mixing their strip-shapes into convolutions, and further mixing their emissive patterns.

Due to the ability of the strips to bunch, intertwine, and fold, their ability to cool themselves by convection is enhanced due to increased area exposure to the surrounding ambient air.

The suit is particularly designed for use at distances of about 50 m or more from an infrared camera or similar detection means. At this distance, the resolution of the detection camera is insufficient to distinguish the different emissivity value strips such that the image appears as a gray, "combination" image. The present invention might even be used at a closer range if the resolution of the camera is sufficiently low. In other words, if the person is too close to a relatively high resolution infrared camera, the camera might be able to distinguish between the individual bright, dark and intermediate colors of the individual strips. However, in normal usage (e.g., greater than 50 m away) and with infrared cameras presently used, the individual bright, dark and intermediate radiation colors blur together to give a gray image. Whether the image is dark gray or light gray depends upon the strips emissivity values and the temperature of the environment. By choosing particular patterns of varying emissivity value strips it is possible to more closely conform to the anticipated environment.

For example, in addition to a foliated environment, the present invention could also be used to mask a human body's radiation sufficiently to blend in with an overcast, relatively cool temperature backdrop.

To avoid those portions of the body which are in prolonged contact with the suit from becoming detectable, a preferred embodiment of the invention includes a set of shoulder pads formed of insulating material such as polyurethane foam which would stand the suit off of the shoulders and back. For the head, a hat could be included as part of the camouflage suit. An insulated helmet or soft hat (e.g., ranger's hat) would be appropriate. Elbow pads of insulating material would also help in avoiding areas of prolonged contact with the human body.

A preferred embodiment of the invention includes a plurality of elongated strips formed of low emissivity material. For example, nylon strips with a silver (emissivity of about 0.02) or a copper (emissivity of about 0.15) coating are strips of material which are low in emissivity. Utilizing the low emissivity strips as a base, the strips can be coated with differing amounts of pigment. Since the pigment has a much higher emissivity value (about 0.89 to 0.97) the application of varying amounts of the pigment or no pigment onto the base strip enables one to easily produce a plurality of strips of varying emissivity.

Further, through use of conventional camouflage paint it is possible to provide a suit which is not only difficult to detect with infrared cameras but also difficult to detect by sight or with cameras operating in the visible spectrum.

Alternatively, a plurality of different material strips can be utilized to achieve the desired diversity in emissivity values; for example, a combination of strips with some of the strips formed of silver coated nylon in combination with strips of different material (e.g., nylon alone) or strips with a plastic resin coating. The different emissivity value strips are positioned such that they are in an overlapping relationship and there is a diverse or random assemblage of the various emissivity value strips. To achieve such an arrangement, the strips are preferably arranged in opposing spiral patterns with no two adjacent strips having the same emissivity value. For example, each spiral pattern of strips could originate at a central point of the underlying layer which, for the personal infrared suit, would be about where the top of the head, hat or helmet would be located. Preferably, a first of the two offsetting spiral strip patterns has a plurality of strip groups (e.g., three strips or more) wherein the sequence of emissivity values in each group is high-lowmedium, low-high-medium, medium-high-low, etc., with no two adjacent groups having adjacent strips of the same emissivity value. The second set of spirally arranged strips is also preferably arranged in a plurality of groups which are arranged different from that of the first pattern such that there is avoided a large amount of overlap of common emissivity value strips. For instance, extensive overlap can be avoided by using the same sequences for each pattern but starting each pattern with a different emissivity value strip.

An alternative embodiment of the present invention places the strips in concentric circles that decrease in diameter in step-like fashion towards the center of the underlying mesh netting. Each concentric circle is provided with a sequence of different emissivity value strips. The lengths of the strips are such that the bottom portions of strips attached at a lower diameter concentric circle overlap the upper attached region of the strips in the next higher diameter concentric circle.

Attachment of the strips to the underlying layer can be achieved through stitching the ends of the strips to the underlying layer, by adhering, by heat bonding, any combination of the foregoing or any similar attachment technique.

The present invention also contemplates the sewing of additional patches of reflective material directly to the underlying ultralight layer. The additional strips can be provided in problem areas but should not be so abundant as to cause a large disruption in air circulation.

In those situations where the user is likely to be climbing over obstacles and the like, the present invention contemplates the use of leggings which are comprised of one or more elastic straps secured about the calfs of the user together with a plurality of variable emissivity strips attached thereto.

The present invention is also contemplated for use over objects other than humans. For example, by draping the camouflage covering over a tank either hot from use or from sitting in the sun, it is possible to mask the tank from detection. As with the personal garment the covering can include a plurality of insulating pads to stand the covering off of the surface of the tank or other object being hidden from infrared detection.

BRIEF DESCRIPTION OF THE DRAWINGS

The advantageous nature of the invention summarized above will become more apparent from the following detailed description of the invention and the accompanying drawings in which.

DETAILED DESCRIPTION OF THE PREFERRED EMBODIMENTS

Figure 1:
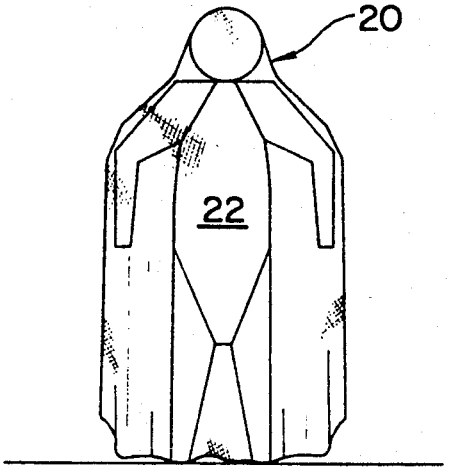
FIG. 1 shows, schematically, the camouflage cover of the present invention placed over a human being.

FIG. 1 illustrates camouflage covering 20 which, in a preferred embodiment, takes the form of a personal infrared camouflage garment draped over human being 22.

Figure 2:
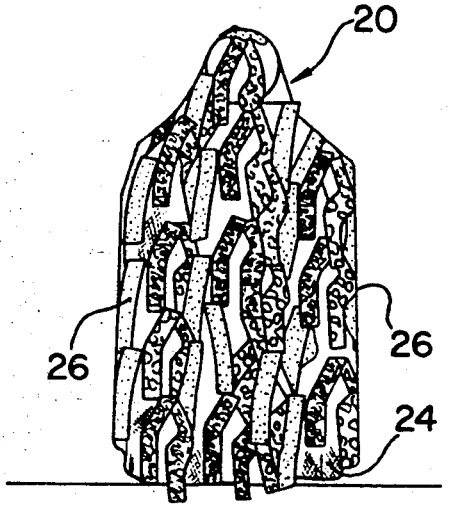
FIG. 2 shows a front elevational view of the camouflage cover over a human being.

FIG. 2 shows an elevational view of that which is shown schematically in FIG. 1. In FIG. 2, personal infrared camouflage garment 20 is shown to feature underlying layer 24 as well as strips 26. As will be explained in greater detail below, strips 26 comprise a plurality of different emissivity value strips attached at one of their ends to underlying layer 24. Underlying layer 24 is formed of a porous material such as a nylon, cotton or polyester mesh or netting. The underlying layer 24 is thus formed of a lightweight material which provides for a large degree of ambient air circulation so as to cool the body. The circulation of the air also helps to dissipate by convection the heat energy stored by the strips.

Attachment of strips 26 to underlying layer 24 can be achieved through use of adhesives or, more preferably, stitchings. Strips 26 thus hang loosely from their attachment point such that the strips can dance and kink as the person moves about. The dancing and kinking creates a chaotic infrared pattern which would conform to a foliage background and the dancing and kinking of the strips also enhances the heat exchange of the strips to the surrounding environment.

To achieve a chaotic pattern which is difficult to detect it is preferable that the varying emissivity value strips be placed randomly and chaotically on underlying layer 24. To avoid unwanted groupings of strips having similar emissivity values, however, the present invention generates a plurality of strip arrangements wherein strips of different emissivity values are arranged in sequences on the preferred patterns.

Figure 3:
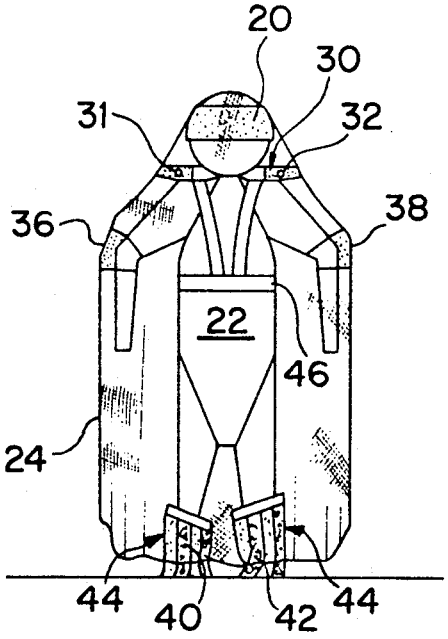
FIG. 3 shows a front elevational view of the insulating members and leggings positioned below the camouflage covering.

FIG. 3 illustrate personal infrared camouflage garment 20 having underlying layer 24 draped over person 22. Underlying layer 24 is spaced at certain points away from person 22 through the use of insulating means. The spacing of underlying layer 24 off of person 22 at the illustrated locations helps avoid the formation of "hot spots" which could easily be detected by an infrared detection device. The insulating means are positioned in those areas where the underlying layer 24 would be in contact for extended periods.

Figure 4:
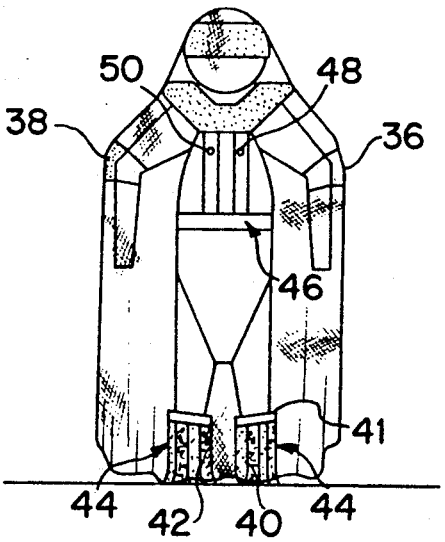
FIG. 4 shows the rear view of that which is shown in FIG. 3.

As shown in FIG. 3, helmet 28 provides an insulating means which positions underlying layer 24 off of the head of person 22. Helmet 28 can include a hard plastic outer shell with internal insulating pads formed of material such as polyurethane. Alternatively, helmet 28 can be replaced by a hat which would position the underlying layer away from the head of person 22. For example, a ranger's hat would be sufficient while a toboggan or a watch cap would not likely provide the insulation desired. In addition to helmet 28, the insulating means can include shoulder pads 30 which are strapped to person 22 such that underlying layer 24 is not in contact with the shoulder of human being 22. Shoulder pads 30 can also be provided with snaps 31 and 32 which, in conjunction with corresponding fasteners 34 (FIG. 11) provided on underlying layer 24, ensure that the camouflage covering is not easily drawn off during use. FIGS. 3 and 4 also illustrate elbow pads. 36 and 38 attached about the arms of person 22 so as to space underlying layer 24 away from the arms. Fastener means can also be provided on the elbow pads 36 and 38.

FIGS. 3 and 4 further illustrate leggings 40 and 42 which include an elastic or the like 41 for attachment to the legs of person 22. A plurality of strips extend off of the elastic 41 (or elastics) and are arranged in a varied sequence of emissivity values. Leggings 40 and 42 prevent the feet and lower leg portions of person 22 from becoming visible to an infrared detection device during movement of human being 22 and in some crouching or lying positions. FIGS. 3 and 4 also illustrate a harness system 46 which is commonly utilized by military personnel and the like. Harness system 46 is shown to include snaps 48 and 50 which could be used in association with a corresponding fastener member secured to underlying layer 24.

Figure 5:
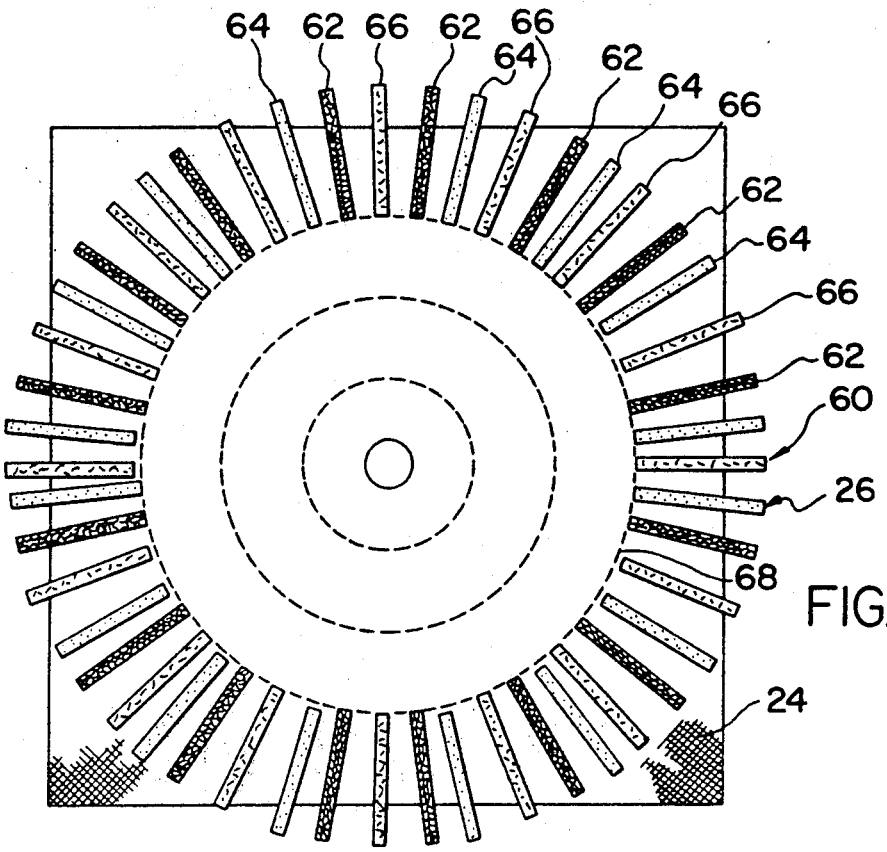
FIG. 5 shows one of the preferred strip placement arrangements with a first sequence of strips applied to the underlying layer.

FIG. 5 illustrates one of the preferred patterns of strip placement. As shown in FIG. 5, underlying layer 24 features a square section of mesh with the mesh only being partially shown for draftsman's convenience. A suitable size for underlying layer 24 would be a square having eight foot sides which would be appropriate for a person having a height of about 5'6" to 6' and would avoid having the person tripping over the lower edge of underlying layer 24. Adjustments could be made to accommodate for individuals with heights above and below the above noted range.

The pattern illustrated in FIG. 5 includes a plurality of concentrically arranged-circles designating the connection point of the strips 26 to underlying layer 24. The first sequence of strips 26, generally designated 60, is shown in FIG. 5 to comprise 56 strips. Sequence 60 utilizes a plurality of three strip combinations which feature strips in varying arrangements. Strip 62 is highest in emissivity value. Strip 66 has an emissivity value which is lower than strip 62 and strip 64 is the strip having the lowest emissivity value of the three strips 62, 64 and 66. As represented by differences in darkness, the strips 62, 64 and 66 are orientated so that no two adjacent strips are the same and there exists a plurality of different groups such as 62-64-66, 64-62-66 and 64-66-62, etc.

Concentric circle 68 is preferably about 6' in diameter while the strips are preferably about 18" in length and 2" in width. The lowest emissivity value strip 64 preferably has a value somewhere between about 0.01 to 0.40 which can include the aforementioned nylon material strips with silver or copper coating. Intermediate strips 66 have an emissivity value preferably between about 0.40 to 0.70. A strip formed of nickel coated copper over nylon material would fall within the above range. Strips 62 preferably have an emissivity value between about 0.70 to about 0.99. Strips formed of carbon coated material (e.g. nylon), which has an emissivity in the 0.70 to 0.99 range, would be a suitable material for strips 62. A value of 0.30 for the low emissivity value strips 64, a value between about 0.50 to 0.60 for the intermediate strips 66 and a value of about 0.85 for the high emissivity strips 62 represents even a more preferred set of values.

Rather than relying on a sequence comprised of groups of three different emissivity value strips, the sequence can be expanded to include groups of 4, 5, 6 or more different emissivity value strips within each sequence. For example, rather than relying upon groups of strips having the three different emissivity values of 0.30, 0.55 and 0.85, the sequence can include groups of four strips having emissivity values of 0.25, 0.45, 0.65 and 0.95.

The present invention also contemplates forming the different emissivity value strips of the same base material. A suitable base material would be silver coated nylon or copper coated nylon as such base material is low in emissivity value. By applying or spraying varying densities of paint onto the low emissivity value base material, the strips can be increased in emissivity in proportion to how dense the paint (or other high emissivity value material) is applied. The use of paint also provides for forming the strips with camouflage colorings such as green, brown and black for anticipated use in foliage environments or various other color combinations for different environments.

Figure 6:
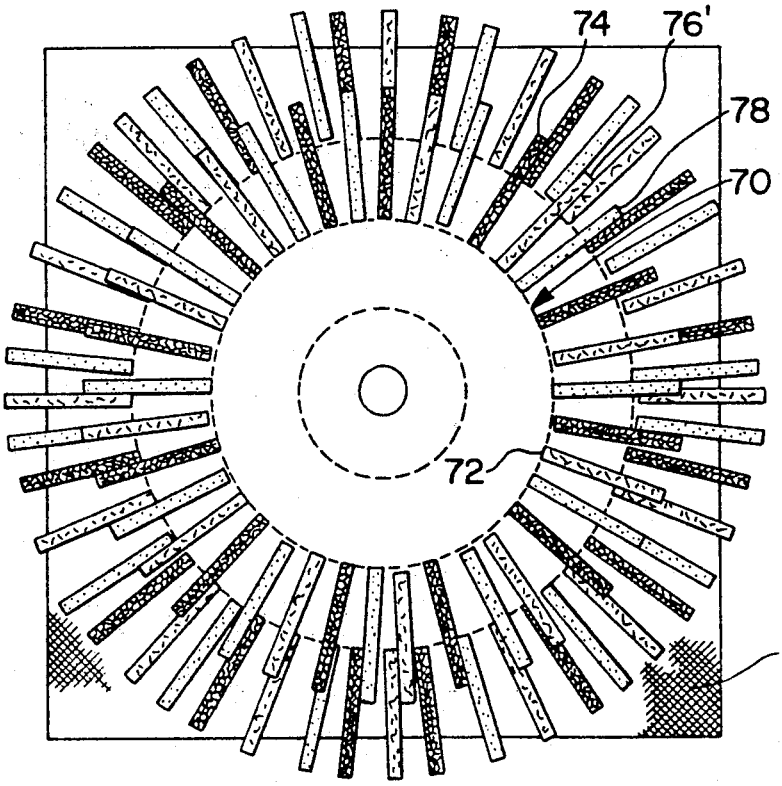
FIG. 6 shows the addition of a second sequence of strips applied to the underlying layer shown in FIG. 5.

FIG. 6 illustrates the placement of a second sequence of strips generally designated 70 along concentric circle 72. Sequence 70 includes groupings of three different emissivity value strips 74, 76 and 78 which are arranged such that no two strips of the same material are adjacent one another and strips arranged along the lower diameter lie intermediate the attachment points of the strips on the higher diameter concentric circle. The diameter of circle 72 is preferably about 4 feet while the strips are again 18 inches long and 2 inches wide. The offsetting of the sequence 70 from that of 68 helps to create a chaotic pattern of emissivity values. FIG. 6 illustrates the placement of about 37 strips along concentric circle 72. Although even more could be used if a denser pattern is desired.

Figure 7:
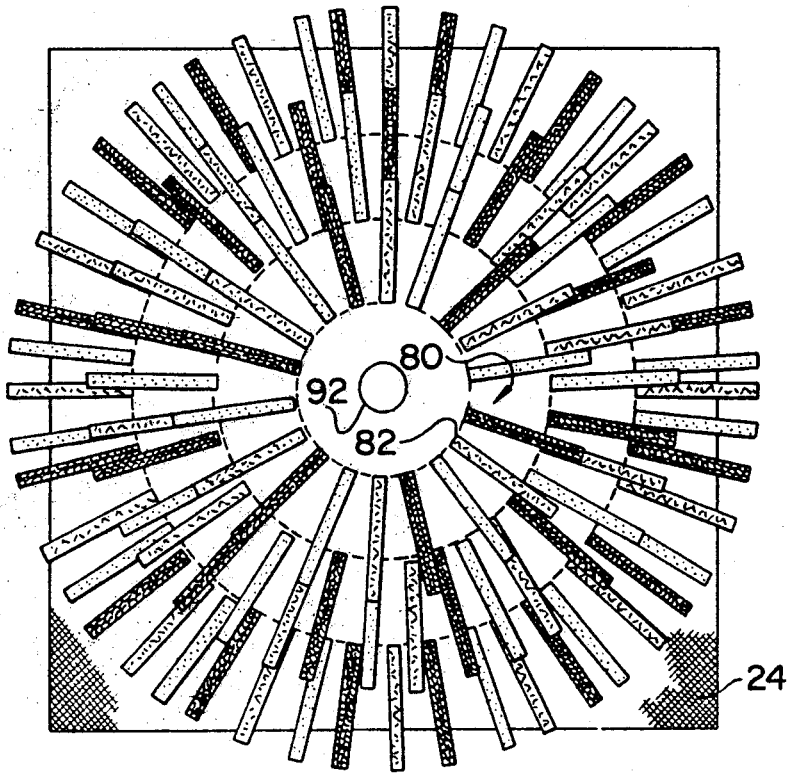
FIG. 7 shows the addition of a third sequence of strips to the underlying layer shown in FIG. 5.

FIG. 7 illustrates the application of another sequence of strips to underlying layer 24 with the sequence generally designated 80. As shown in FIG. 7, concentric circle 82 represents the attachment point of the strips in sequence 80. In a preferred embodiment, concentric circle 82 is about 2 feet in diameter. Again, the strips in sequence 80 are about 18 inches in length and 2 inches in width. This size for the strips ensures that the strips attached to an inner concentric circle overlap with the upper portion of the strips in an outer concentric circle. Also, the 2 inch width provides for some overlap between the side edges of the strips attached to one concentric circle with respect to the strips attached to another concentric circle.

Figure 8:
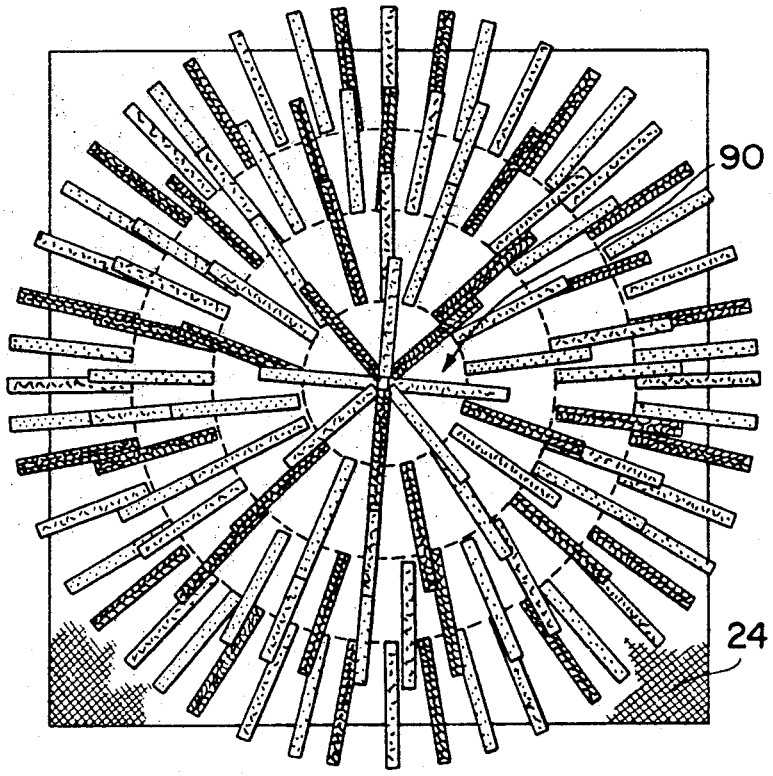
FIG. 8 shows the placement of the final sequence of strips to the underlying layer shown in FIG. 5.

FIG. 8 illustrates the final sequence 90 which is applied to underlying layer 24. The strips in sequence 90 are attached to concentric circle 92 shown in FIG. 7 which is preferably about 7 inches in diameter. Again, the strips in sequence 90 are arranged in a sequence which ensures that no two strips having the same emissivity value are placed adjacent one another. The number of strips in sequence 90 is preferably about eight or more while the number of strips in sequence 80 is preferably about 18 or more. Although the number of strips shown in FIGS. 5-8 would be suitable for most operations, it is also contemplated that the number of strips can be increased to achieve a denser arrangement (e.g., adjacent strips on the same circle having their side edges overlapping).

Figure 9:
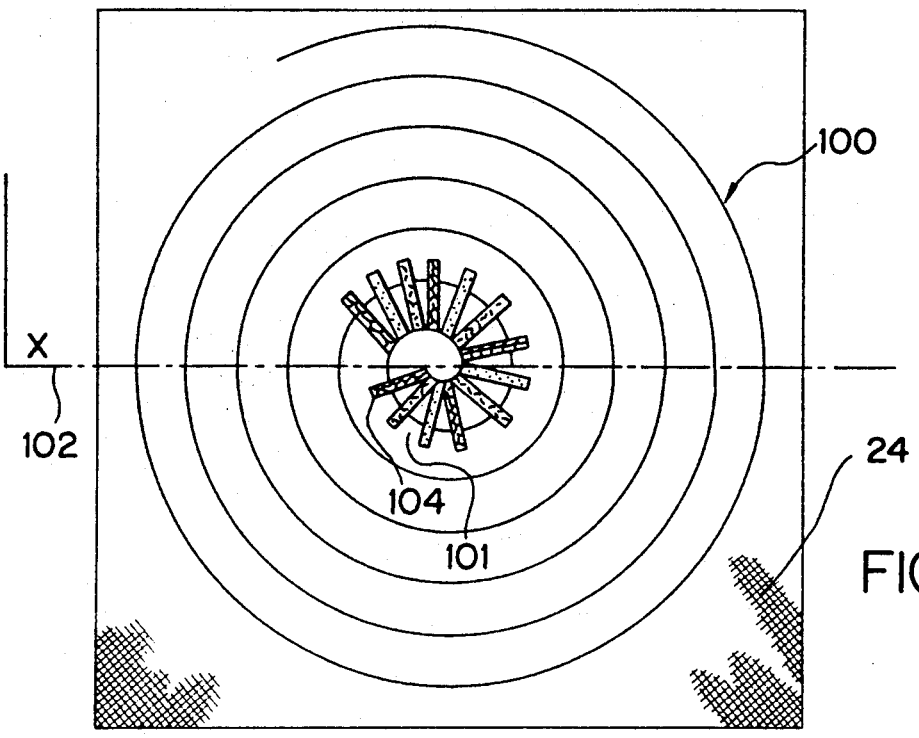
FIG. 9 shows another preferred arrangement of the strips on the underlying layer.

FIG. 9 illustrates an alternate pattern for placement of different emissivity value strips onto underlying layer 24. In FIG. 9, a first spiral strip attachment pattern 100 is shown. Again, underlying layer 24 is preferably formed of a square having about 8 foot sides. The spiral arrangement preferably has its spirals spaced by about 18 inches with respect to the X axis designated 102 in FIG. 9. Spiral pattern 100 provides a pattern upon which one end of strips 104 are attached. The sequence of strips 104 includes different emissivity value strips arranged in a plurality of groups of three or more strips with different emissivity values. The sequence is such that no two adjacent strips have the same emissivity value. For example, the sequence of strips in strip sequence 101 features strips within groups of three each with a different emissivity value (high, intermediate and low). Although not shown, the groups of strips would continue to a point near or at the end of the spiral pattern illustrated.

In FIG. 9, the strip attached to the central point of spiral 100 is shown to be a high value emissivity strip, although the sequence could have begun with any of the three different value emissivity strips. Sequence 101 in FIG. 9 can also include groups having more than three emissivity value strips such as 4, 5 or more. The strips are of a length which essentially places their free end in the middle region between adjacent spirals of spiral pattern 100. Thus, the above below overlapping shown for FIGS. 5–8 is also present in the sequence shown in FIG. 9. A suitable strip length for the spiral pattern shown in FIG. 9 would be about 24 inches.

Figure 10:
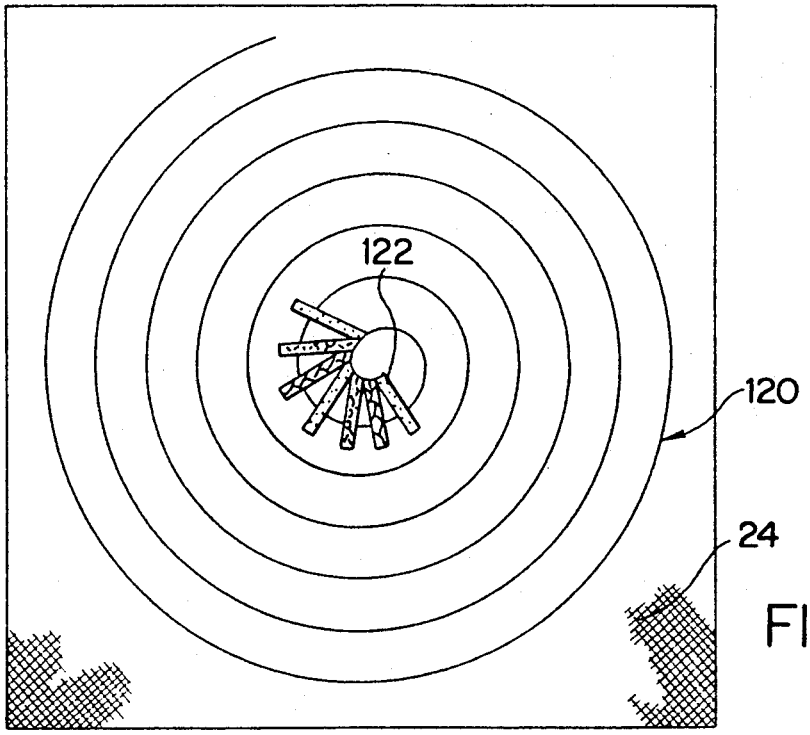
FIG. 10 shows an oppositely orientated spiral as that shown in FIG. 9.

FIG. 10 shows a second spiral strip attachment pattern 120 with only a few of the strips which would be attached shown. The spiral pattern 120 rotates in a direction which is opposite to the first spiral strip pattern 100. In a preferred embodiment, the spiral strip pattern 120 would be superimposed upon the spiral strip pattern 100 with the sequence in spiral strip pattern 120 beginning with a different strip than that of sequence 100. For example, FIG. 10 illustrates strip 122 located at the center point of spiral pattern 120 to be of a strip lowest in emissivity value. Accordingly, when the strip pattern shown in FIG. 10 is superimposed over the strip pattern shown in FIG. 9 there would be a random and chaotic arrangement of the strips when the two spiral patterns are joined to the underlying layer 24.

The spacing of the attachment points for each of the strips in the pattern shown in FIGS. 9 and 10 is preferably about 2 inches. Also, when the spiral pattern 120 is superimposed over the spiral pattern 100 the center points are preferably offset somewhat such that the strips of one spiral pattern fall between adjacent strips of the other spiral pattern. Also, the spiral pattern 120 preferably is spaced along the X-axis about 18 inches.

Figure 11:
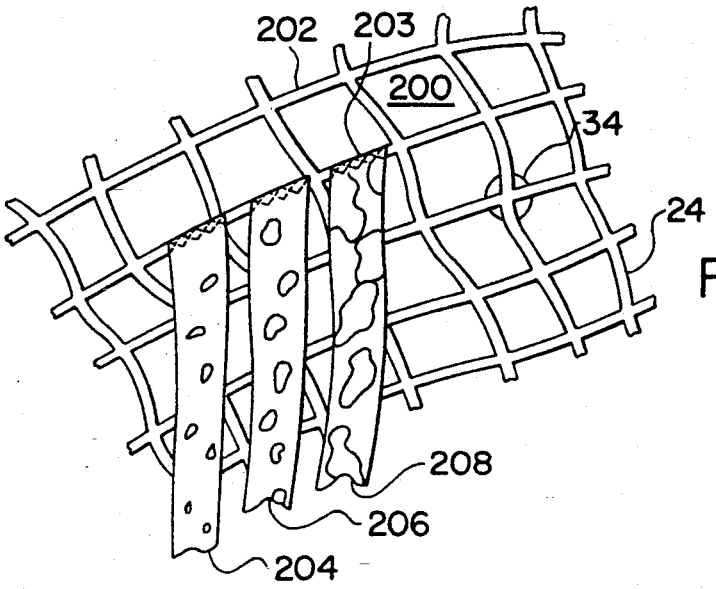
FIG. 11 shows a close up cut away view of the underlying layer together with a few of the strips attached.

FIG. 11 illustrates a close up view of a portion of underlying layer 24 which preferably is in the form of a knitted mesh, knotted netting or any other similar lightweight porous structure. In a preferred embodiment, underlying layer 24 is a knitted nylon mesh whose openings 200 have an area of between about 0.016 square inches to 0.58 square inches and more preferably about 0.25 square inches. The thickness of the interconnecting members 202 is preferably about 1/16 of an inch. Elongated strips 204, 206 and 208 are attached at one of their ends to underlying layer 24 by way of attachment means 203. Attachment means 203 can include a threaded attachment of the strips to interconnecting strands 202, an adhesion to member 202, a heat bonding of the strips to strands 202 or any combination of the above. An alternate manner of attaching strips to the underlying layer is through use of nylon tag pins. These nylon tag pins are the nylon loops used to attach price tags to clothes. Attachment is achieved by use of a tagging gun (hand held or automated) which pushes a needle of the tagging gun through the strip and netting whereby, following trigger activation, the tag pin joins the strip and underlying netting together. "Fine tag pins" and associated tagging guns are marketed by Yeah Hsian Enterprises Co., Ltd., Taiwan (R.O.C.). FIG. 11 also illustrates the fastener 34 previously discussed as being part of the securement means which secures the personal infrared garment to the person utilizing the garment.

Figure 12:
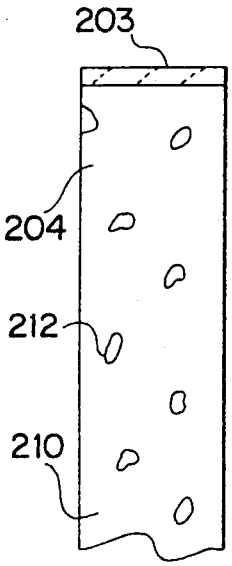
FIG. 12 shows a partially cut away, planar view of a low emissivity value strip.
Figure 13:
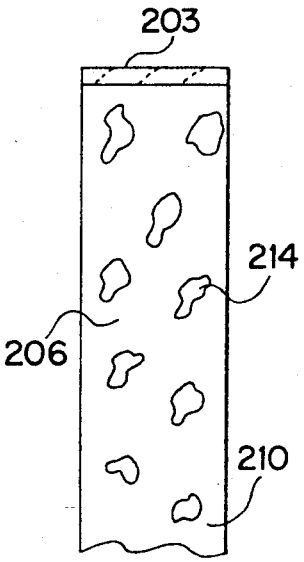
FIG. 13 shows a partially cut away, planar view of an intermediate emissivity value strip.
Figure 14:
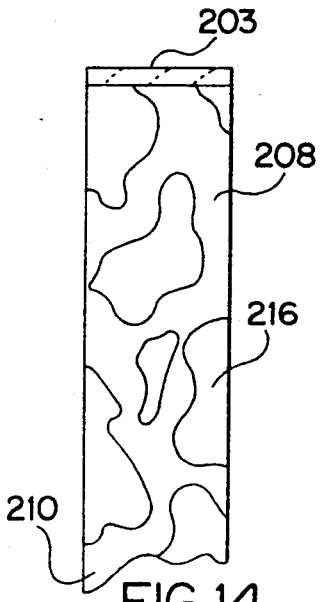
FIG. 14 shows a partially cut away, planar view of a high emissivity value strip.

FIGS. 12, 13 and 14 illustrate partially cut away close up views of three strips having different emissivity values. FIG. 12 shows exemplary strip 204 which features an underlying base 210 partially coated with a coating material such as pigment or paint shown as blotches 212.

The coating material described here may be a paint or some sort of pigment that has a very high emissivity (greater than 0.9) in the infrared bands and visually appears as some color. The process of tailoring the emissivity value of the strip in accordance with the present invention has been coined "multispectral half toning". The process of multispectral half toning works as follows:

The strip has a total area =AT:

The strip also has a composite emissivity $\epsilon_T$ as a result of the half toning process.

The total area of the strip is given by:

$$AT = AH + AL$$

where AL is the area of the low emissivity strip not covered with pigment, and AH is the area of the strip covered with high emissivity pigment.

The percentage of the total area of the strip covered with high emissivity pigment, $\alpha_H$ is given by:

$$\alpha_H = \frac{A_H}{A_T}$$

and the percentage of the total area of the strip not covered with pigment, $\alpha_L$, is given by:

$$\alpha_L = \frac{A_L}{A_T}.$$

The emissivity of the total strip, then, is given by:

$$\epsilon T = \alpha H \epsilon H + \alpha L \epsilon L$$

where $\epsilon_L$ is the emissivity of the strip, and $\epsilon_H$ is the emissivity of the pigment.

The blotches of coating material 212 shown in FIG. 12 and applied in accordance with the "multispectral half toning" are preferably relatively small (e.g., on the average 0.4 to 0.6 square inches in surface area) and spaced sufficiently apart so as to cover about 10% of the strips total front surface and achieve approximately the predetermined emissivity value desired for strip 204.

The 10% value is suitable for the purposes of the present invention and, based on the multispectral half toning method described above, the blotches on strip 204 provide an overall emissivity value ($\epsilon T$) of 0.229. The overall emissivity value is determined as follows:

The blotches on the strip in FIG. 12 roughly cover about 10% of the total area of the strip. With strips preferably having a total area of about 36 square inches, the blotches would encompass about 3.6 square inches of the strips face. If the pigment emissivity is about 0.94, and the strip emissivity about 0.15, then the composite emissivity ($\epsilon T$) equals:

$$\epsilon T=(0.1)(0.94)+(0.9)(0.15)=0.229$$

The blotches 212 can also be of various colors so as to provide visual as well as infrared camouflage material.

FIG. 13 illustrates an intermediate emissivity value strip 206 having blotches 214 which are larger, on the average, than that shown for strip 204 (e.g., 1.2 to 1.4 square inches in surface area). Again, blotches 214 are spaced apart so as to cover about 33% of strips 206 and achieve the desired higher emissivity value. In other words, the high emissivity value pigment has the effect of increasing the overall emissivity value of the strip by adding to the low emissivity value of the underlying base material 210. In using the multispectral half toning method described above with the same emissivity values for the pigment and strip, the composite emissivity value is about 0.49.

FIG. 14 illustrates the higher value emissivity strips 208 which are again formed from the same underlying base material 210. Secured to or applied to underlying base material 210 are blotches 216 which are larger, on the average, than that for strips 204 and 206 (e.g., 3.3 to 3.5 square inches) so as to cover about 67% of the front surface area of strip 208. The blotches in strip 208 can also be of various colors (green, brown and black) to provide visual camouflage characteristics to the strips. The emissivity value for strips 208 works out roughly to about 0.70 for the composite emissivity value ($\epsilon T$).

Figure 15:
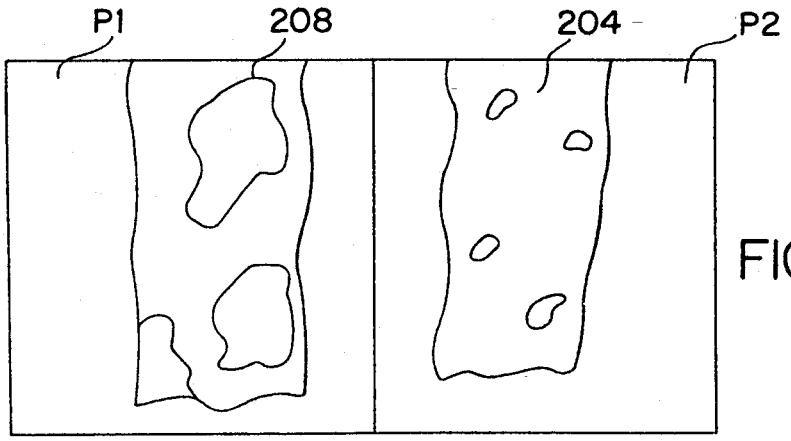
FIG. 15 shows pixels of an infrared camera focused on a pair of strips.
Figure 16:
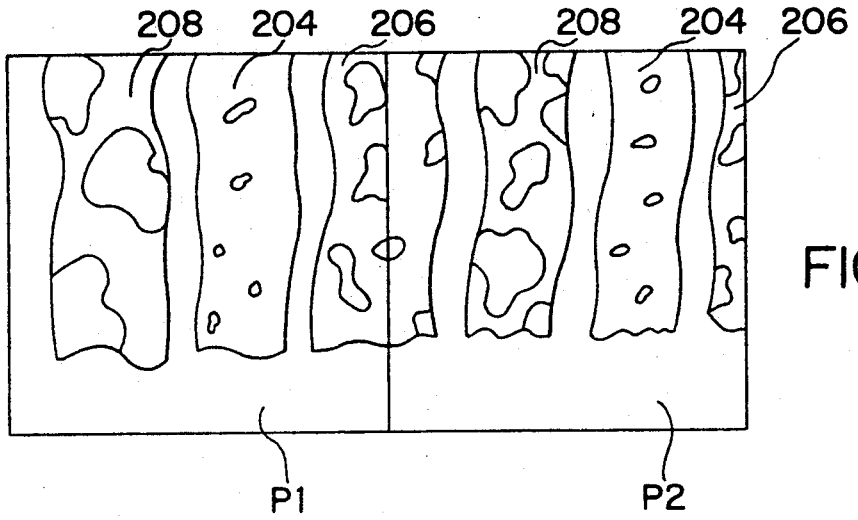
FIG. 16 shows a pair of pixels of an infrared camera which is focused on a plurality of strips.

FIGS. 15 and 16 illustrate two different views taken by an infrared camera. In FIG. 15 first pixel p1 and second pixel p2 are illustrated. Entirely within pixel p1 is high emissivity value strip 208 and entirely within pixel p2 is low emissivity value strip 204. FIG. 15 thus illustrate either a high resolution infrared camera and/or strips placed in very close proximity (e.g., approximately 10 meters for an infrared camera with a pixel field-of-view of 10 milliradians) from the camera.

FIG. 16 illustrates the pixels which would result when an infrared camera having either a lower resolution than the camera in FIG. 15 is utilized or when the strips are placed further away from the camera than the distance in FIG. 15.

As shown in FIG. 16, a portion of the intermediate emissivity value strip 206 and all of the lower emissivity value strip 204 and the higher emissivity value 208 are contained within each pixel. With this arrangement, the infrared camera would detect essentially the average of the different emissivity values such that a gray image is detected by the camera. Accordingly, the strips of the camouflage covering would act to create an image which is a combination of slightly varying shades of gray with darker gray areas resulting from those pixels having a higher content of low emissivity value strips as opposed to high emissivity value strips. The lighter gray areas of the image are the result of the pixels containing a greater percentage of high emissivity value strips as opposed to low emissivity value strips.

Figure 17:
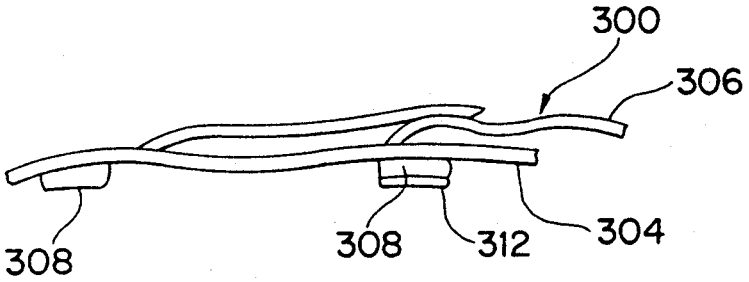
FIG. 17 shows a cut away side view of the camouflage covering designed for positioning over an object.
Figure 18:
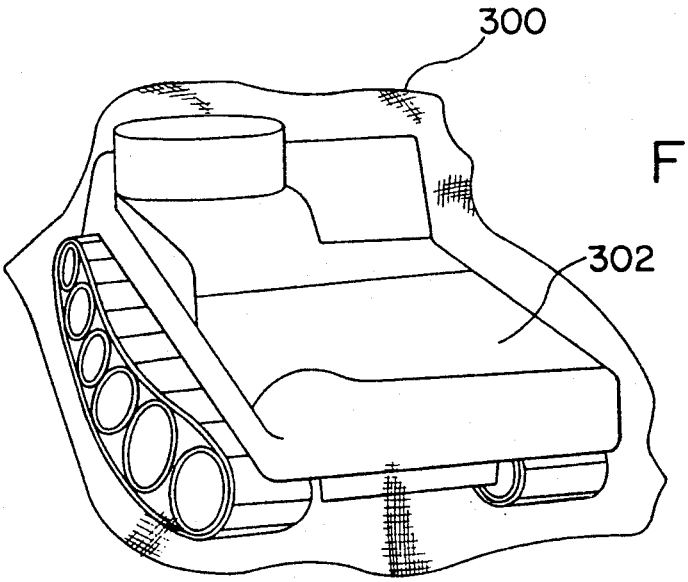
FIG. 18 shows an object with the camouflage covering of FIG. 17 draped thereover.

FIGS. 17 and 18 illustrate an alternate embodiment of the invention wherein camouflage covering 300 is used to prevent the detection of an object such as tank 302. As shown in FIG. 18 camouflage covering 300 is draped over tank 302. FIG. 17 illustrates a broken away side view of camouflage covering 300. Camouflage covering 300 features an underlying layer 304 which is formed essentially the same as that for the personal infrared camouflage garment. Strips 306 are designed and attached to underlying layer 304 in essentially the same manner as that previously described for the personal infrared camouflage garment. Also, the previously described patterns for positioning the various emissivity value strips can also be utilized in applying strips 306 to underlying layer 304.

To prevent prolonged contact between the object being protected from detection and the camouflage covering 300, blocks of insulating material can either be positioned on the object being protected (e.g., tank 302) or, as illustrated in FIG. 17, a plurality of insulating pads 308 can be secured to underlying layer 304 such as by adhesive. Insulating pads 308 can also be provided with a tacky lower surface 312 to provide added securement to the object and also to allow for tensioning of underlying layer 304 such that portions of underlying layer 304 positioned between pads 308 do not come in contact with the underlying object.

Although the present invention has been described with reference to preferred embodiments, the invention is not limited to the details thereof. Various substitutions and modifications will occur to those of ordinary skill in the art, and all such substitutions and modifications are intended to fall within the spirit and scope of the invention as defined in the appended claims.

What is claimed is:

1. A camouflage covering for avoiding detection of an underlying object by an infrared detection device, comprising:

an underlying layer formed of a porous material with openings sufficiently large enough as to allow for air flow therethrough;

a plurality of elongated strips which each include a first end and a second end, said strips being secured to a first side of said underlying layer and said strips being secured so as to have strips on said first side in an overlapping arrangement with other strips on said first side, said strips being secured to said underlying layer only at said first end such that said strips are adapted to dangle freely off from said underlying layer, said strips each having an exterior surface which faces away from said underlying layer and has a certain emissivity value, and the exterior surfaces of said strips presenting at least three different emissivity values with the different emissivity value strips being arranged on said underlying layer so as to create a pattern of heat emissions which correspond with an intended background and masks an infrared signature of an underlying object so as to make detection by the infrared detection device difficult.

2. A camouflage covering as recited in claim 1 wherein said underlying layer is a flexible net with a plurality of openings having an area greater than 0.016 square inches.

3. A camouflage covering as recited in claim 1, wherein said strips include a base layer of material with a material placed thereon which is higher in emissivity value than said base layer.

4. A camouflage covering as recited in claim 3, wherein said higher emissivity material is a pigment.

5. A camouflage covering as recited in claim 4, wherein said pigment is arranged in blotches on said strips and has an emissivity value greater than 0.90.

6. A camouflage covering as recited in claim 5, wherein said blotches include blotches of different colors.

7. A camouflage covering as recited in claim 1 wherein said strips are secured by tag pins.

8. A camouflage covering as recited in claim 1, wherein said strips are arranged in concentric circles about a center point on said underlying layer.

9. A camouflage covering as recited in claim 8, wherein said strips have overlapping ends.

10. A camouflage covering as recited in claim 9, wherein side edges of said strips are in an overlapping relationship.

11. A camouflage covering as recited in claim 1, wherein said strips are arranged in a spiral pattern about a center point on said underlying layer.

12. A camouflage covering as recited in claim 11, wherein groups of at least three strips of different emissivity values are attached along said spiral pattern.

13. A camouflage covering as recited in claim 1, wherein said strips are securely positioned on a pair of opposing spiral patterns formed on said overlying layer.

14. A camouflage covering as recited in claim 1, wherein said strips are arranged such that adjacent strips are formed of a material of different emissivity.

15. A camouflage covering as recited in claim 1, wherein said strips are formed of the same base layer and said strips have different amounts of a coating material coated on at least one surface of said strips such that said strips assume different emissivity values.

16. A camouflage covering as recited in claim 11, wherein said strips include a first set of strips each having a first of the three different emissivity values, a second set of strips each having a second of the three different emissivity values, and a third set of strips each having a third of the three different emissivity values.

17. A camouflage covering as recited in claim 16 wherein said first emissivity value is in the range of 0.01 to 0.40, said second emissivity value is in the range of 0.40 to 0.70 and the third emissivity value is in the range of 0.70 to 0.99.

18. A camouflage covering as recited in claim 1 wherein said elongated strips overlap in end-to-end fashion.

19. A camouflage covering as recited in claim 18 wherein said strips overlap in side-to-side fashion.

20. A camouflage covering as recited in claim 1 wherein said strips overlap in side-to-side fashion.

21. A camouflage covering as recited in claim 1 wherein said three different emissivity values include a low emissivity value, an intermediate emissivity value, and a high emissivity value and the three different emissivity value strips are arranged on said underlying layer so as to avoid having adjacent strips having a common emissivity value.

22. A camouflage covering as recited in claim 1 wherein said strips are formed of flexible fabric.

23. A camouflage covering as recited in claim 22, wherein said flexible fabric is formed of a material which includes metallic material.

24. A camouflage covering as recited in claim 23, wherein said flexible fabric includes is silver coated nylon.

25. A camouflage covering as recited in claim 1 wherein said covering is in the form of a personal camouflage garment which is dimensioned and arranged for covering a human being and said covering including means for covering the legs of an underlying human.

26. A camouflage covering as recited in claim 25 further comprising insulating pads secured to a second side of said underlying layer and dimensioned and arranged so as to prevent said underlying layer from directly contacting a portion of the underlying human.

27. A camouflage covering as recited in claim 26 wherein said insulating pads include shoulder, knee and elbow pads.

28. A camouflage covering as recited in claim 1 wherein said three different emissivity values include a low emissivity value, an intermediate emissivity value and a higher emissivity value, and wherein at least a portion of the exterior surface of each of said low emissivity value strips, intermediate emissivity value strips and higher emissivity value strips is of a common low emissivity value material and each of said intermediate and higher emissivity value strips have a higher emissivity value based on multispectral half-toning wherein a pigment, having a higher emissivity value than said common material, is provided on said common material, in accordance with equations (i), (ii), and (iii);

$$\epsilon_T = \alpha_H \epsilon_H + \alpha_L \epsilon_L \quad \text{(i)}$$

$$\alpha_H = \frac{A_H}{A_T} \quad \text{(ii)}$$

$$\alpha_L = \frac{A_L}{A_T} \quad \text{(iii)}$$

with $A_L$ being an area of coverage of said exterior surface of a strip comprising said common material, $A_H$ being an area of covering by said exterior surface of a strip comprising said pigment, $A_T$ being a total area of said exterior surface, $\epsilon_H$ being an emissivity value of the pigment, $\epsilon_L$ being an emissivity value of said common material, and $\epsilon_T$ being an overall emissivity value of the strip, and said higher emissivity value strips having an $\alpha_H$ value which is greater than the $\alpha_H$ value for said intermediate value emissivity strips.

29. A camouflage covering as recited in claim 1 wherein strips are provided on only said first side of said underlying layer.

* * * * *